US006938351B2

(12) United States Patent
Kobayashi et al.

(10) Patent No.: US 6,938,351 B2
(45) Date of Patent: Sep. 6, 2005

(54) IMAGE FORMING DEVICE

(75) Inventors: Mikio Kobayashi, Ebina (JP); Makoto Ochiai, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 7 days.

(21) Appl. No.: 10/793,223

(22) Filed: Mar. 5, 2004

(65) Prior Publication Data

US 2005/0063739 A1 Mar. 24, 2005

(30) Foreign Application Priority Data

Sep. 18, 2003 (JP) ..... 2003-325786

(51) Int. Cl.[7] ..... G03G 15/01
(52) U.S. Cl. ..... 33/299; 399/313
(58) Field of Search ..... 399/299, 298, 399/313

(56) References Cited

U.S. PATENT DOCUMENTS 3,690,756 A * 9/1972 Smith ..... 399/179
5,678,150 A * 10/1997 Takahashi et al. ..... 399/299
6,134,415 A * 10/2000 Iwakura et al. ..... 399/299
6,356,718 B1 * 3/2002 Matsumoto ..... 399/40
6,389,260 B1 * 5/2002 Kataoka et al. ..... 399/298
6,507,713 B2 * 1/2003 Koide ..... 399/51
6,681,094 B2 * 1/2004 Horall et al. ..... 399/299
6,823,158 B2 * 11/2004 Yamada et al. ..... 399/179
6,853,829 B2 * 2/2005 Hoshi et al. ..... 399/299

FOREIGN PATENT DOCUMENTS

JP 2000-242057 9/2000

* cited by examiner

*Primary Examiner*—Christopher W. Fulton
*Assistant Examiner*—Amy R. Cohen
(74) *Attorney, Agent, or Firm*—Morgan, Lewis & Bockius LLP

(57) ABSTRACT

An image forming device has plural photoreceptor drums on which a latent image is formed, wherein one of the photoreceptor drum is different diameter from the other photoreceptors. A belt in contact with the plural photoreceptor drums and plural transfer rollers press the photoreceptor drums from a side of the belt, the side being opposite to the side contacts with the photoreceptor, wherein a distance from a contact reference position. The contact reference position at which the photoreceptor contacts with the belt, to a pressed position of the transfer roller of a large-diameter photoreceptor drum is greater than that of a small-diameter photoreceptor drum.

7 Claims, 5 Drawing Sheets

IMAGE FORMING DEVICE

BACKGROUND OF THE INVENTION

1. Field of the Invention

The present invention relates to an image forming device that forms a color image by superimposing toner images of plural colors, and more particularly to an image forming device wherein a photoreceptor drum having an electrostatic latent image formed thereon and a developing device for making the latent image visible are provided for every color, whereby each of the formed toner images is laid over a recording medium transported on an intermediate transfer belt or a transport belt to thereby be transferred thereon.

2. Description of the Related Art

There have been proposed some types of image forming device for forming a color image by use of a toner. These include the followings of:

(a) the type having a single photoreceptor drum, wherein a toner image of a different color is successively formed thereon so as to be superimposed and the formed images are transferred all together onto a recording medium;

(b) the type having a single photoreceptor drum, wherein a toner image of a different color is successively formed thereon, the formed toner image of each color is transferred onto an intermediate transfer medium or on a recording medium, and then, the toner images are superimposed onto the intermediate transfer medium or on the recording medium;

(c) the so-called tandem type having photoreceptor drum and developing device for every color, wherein toner images are superimposed to be transferred onto a recording medium transported by an intermediate transfer belt or a transport belt.

Among these types, the tandem type image forming device is fast in image forming speed, so that it becomes a mainstream of a color image forming device. Such a tandem type image forming device has a photoreceptor drum, a developing device, a charging device, a cleaning device and a transferring device for every color of yellow, magenta, cyan and black. Each of these used image forming units generally has the specification totally same as one another. The use of the same image forming units allows to facilitate the management upon the manufacture and the supply of the components, thereby being capable of fabricating the device with low cost. Further, a uniform image can be formed for each color, and further, the maintenance management, setting and adjustment can be facilitated.

However, the images formed by use of the image forming device described above include a color image and a monochrome image of only a character or the like, so that the device is usually used to switch these modes. When a monochrome image is formed with the image forming device described above, only a unit for forming a black toner image is driven to form an image. Therefore, in the case where the photoreceptor drum is used as an image-bearing member, the used amount of the photoreceptor drum for black is remarkably more increased than that of the photoreceptor drum for forming the toner image of another color, with the result that only the photoreceptor drum for black is required to be exchanged at an early stage. In view of the abovementioned circumstance, an image forming device has been proposed wherein a large-diameter drum is used only for a photoreceptor drum for black (Patent Reference 1). In this device, the useful period of the photoreceptor drum for black is prolonged since the large-diameter photoreceptor drum allows to decrease the number of rotation to thereby reduce the number of times for forming an image on the peripheral surface. Therefore, the useful period of the photoreceptor drum for black becomes close to the useful period of the photoreceptor drums for another colors, thereby facilitating the management of the device.

It is to be noted that the image forming unit for forming the black toner image is frequently disposed at the most downstream side in the moving direction of the intermediate transfer belt or the transport belt in such tandem type image forming device. This is because this configuration shortens the period from the start of the formation of the toner image to the secondary transfer onto the recording medium via the transfer of the formed image onto the intermediate transfer belt, thereby improving the speed of the image formation.

[Patent Reference 1]

Japanese Published Unexamined Patent Application No. 2000-242057

There are the following subjects that are desired to be solved in the image forming device as mentioned above having photoreceptor drum, developing device and transferring device for every color of toner, wherein the diameter of each photoreceptor drum is different with respect to the color of toner.

When the toner image formed on the photoreceptor drum is transferred to the recording sheet carried on the intermediate transfer belt or the transport belt, its condition is different depending upon the difference in the diameter of the photoreceptor drum. The difference in the transfer condition is remarkable in a transferring device wherein a conductive roller is brought into contact with a photoreceptor drum from the back surface of the intermediate transfer belt or the transport belt to push the photoreceptor drum and a bias voltage for the transfer is applied between the conductive roller and the photoreceptor drum. Specifically, the intermediate transfer belt on which the toner image is transferred gets close to the peripheral surface of the photoreceptor drum, and it is separated from the peripheral surface after it comes in contact therewith. The regions where the intermediate transfer belt gets close to the peripheral surface of the photoreceptor drum and is separated therefrom and the speed for passing through these regions are different. When the bias voltage for the transfer is applied, a discharge occurs at a minute space immediately before the contact and immediately after the separation. The state of this discharge is varied when the diameter of the photoreceptor drum is different, so that the transferability becomes different. Further, the change in the diameter of the photoreceptor drum allows to cause a difference in contact area between the photoreceptor drum and the intermediate transfer belt or the like, with the result that, when the transfer roller is pushed to the photoreceptor drum with the same force, the contact pressure is changed.

As described above, the transferring condition is made different in electrical factors and pressure factors by the difference in the diameter of plural photoreceptor drums used in the same device, so that the transferability is changed for every color of each toner. The difference in the transferability for every color of each toner as described above causes to change a tone when the toner images are superposed, thereby deteriorating an image quality.

SUMMARY OF THE INVENTION

The present invention is accomplished in view of the abovementioned subject.

In order to solve the abovementioned subject, there is provided an image forming device having, a plurality of photoreceptor drums on which a latent image is formed, wherein one of the photoreceptor drum is different diameter from the other photoreceptors, a belt in contact with a plurality of the photoreceptor drums and a plurality of transfer rollers pressing the photoreceptor drums from a side of the belt, the side being opposite to the side contacting with the photoreceptor, wherein a distance from a contact reference position, the contact reference position at which the photoreceptor being contact with the belt, to a pressed position of the transfer roller of a large-diameter photoreceptor drum is greater than that of a small-diameter photoreceptor drum.

BRIEF DESCRIPTION OF THE DRAWINGS

Preferred embodiments of the present invention will be described in detail based on the following figures, wherein.

DESCRIPTION OF THE PREFERRED EMBODIMENT

Figure 1:
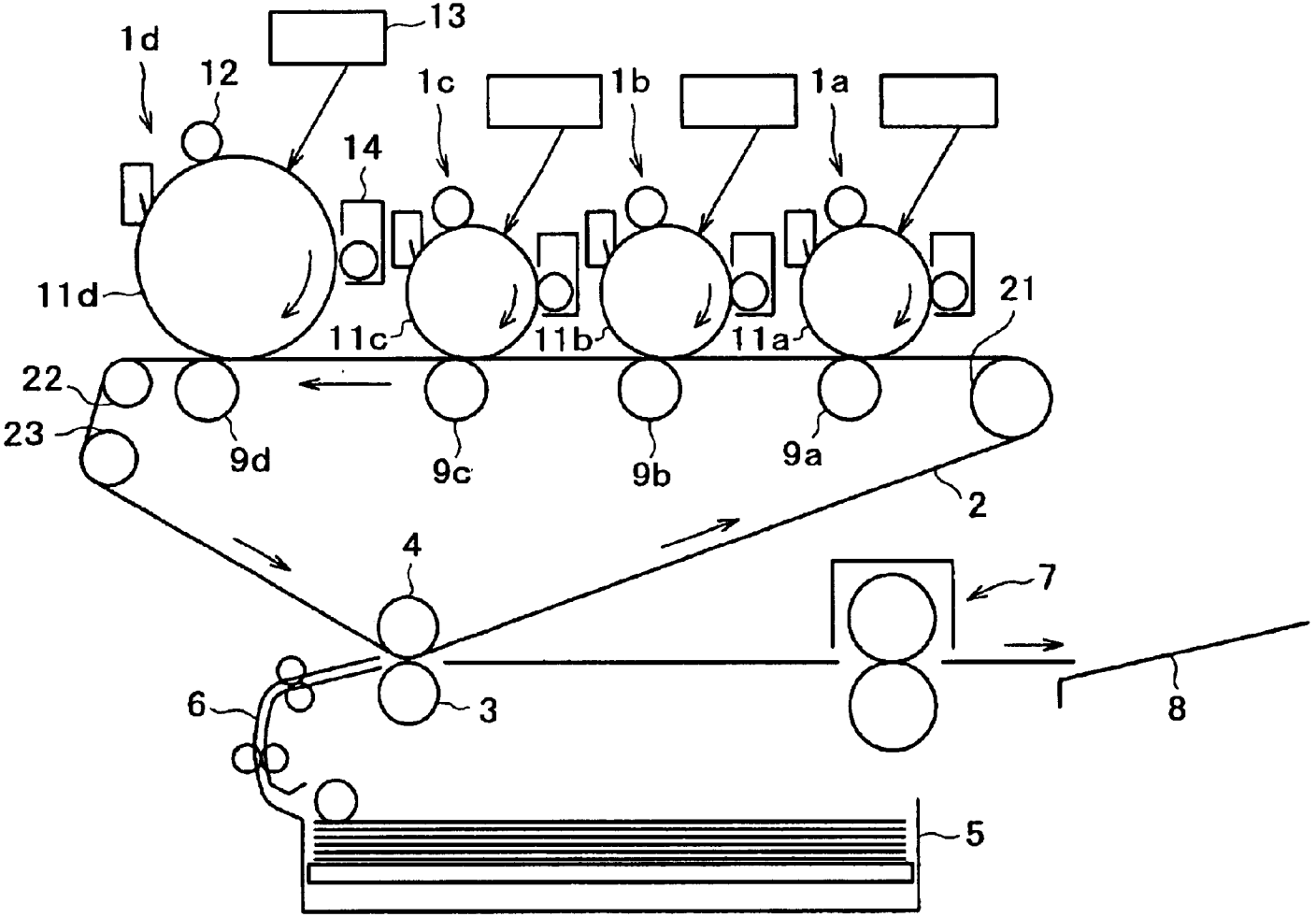
FIG. 1 is a schematic constructional view of an image forming device according to one embodiment of the present invention.

The present invention is accomplished in view of the abovementioned subject, and aims to provide an image forming device having plural photoreceptor drums, each having a different diameter, for superposing to transfer toner image formed on each photoreceptor drum, wherein transferability of the toner image of every color is adjusted, so that all toner images are satisfactorily transferred even if the diameter of the photoreceptor drum is different.

In order to solve the abovementioned subject, an image forming device according to the present invention has plural photoreceptor drums on which a latent image is formed on a cylindrical peripheral surface by a difference in electrostatic potential and on which toner images of different colors are respectively formed due to deposition of toner, an endless belt looped between two support rollers so as to be in contact with any one of the plural photoreceptor drums wherein the toner images on the photoreceptor drums are superposed to be transferred onto an outer peripheral surface or a recording sheet carried on the outer peripheral surface, and transfer rollers that are in pressed contact with the respective photoreceptor drums from an inner side of the endless belt, wherein the plural photoreceptor drums include one having a different diameter from one another. The transfer rollers are made of an identical material and have an identical diameter. Each of the transfer rollers is in pressed contact with each of the photoreceptor drums at a downstream side with respect to a moving direction of the endless belt from a position of the peripheral surface of the photoreceptor drum where a radius of the photoreceptor drum is approximately perpendicular to a direction that the endless belt is looped, i.e., a contact reference position. As for each of the photoreceptor drums, a distance from the contact reference position to a pressed position of the transfer roller of a large-diameter photoreceptor drum is set greater than that of a small-diameter photoreceptor drum.

In this image forming device, the opposing position of each transfer roller to each photoreceptor drum having a different diameter is different. Specifically, adjusting the position of the transfer roller corrects the difference in transferability caused by the difference in the diameter of the photoreceptor drum, thereby being capable of adjusting to perform a satisfactory transfer with respect to any one of the photoreceptor drums.

Two operations are considered as the electrical factors for adjusting the transferability by the position of the transfer roller as described above. One of them is that a minute discharge occurs at the position immediately before the photoreceptor drum is brought into contact with the intermediate transfer belt or the recording sheet to which the toner image is transferred and at the position immediately after the photoreceptor drum is separated from the contact state, the condition of which is adjusted. Specifically, immediately after the separation, the toner image transferred onto the intermediate transfer belt or the like is disturbed by the minute discharge, thereby causing an image loss. When the position of the transfer roller to the large-diameter photoreceptor drum is set at the downstream side, the condition of each photoreceptor drum when the intermediate transfer belt or the like is separated from the photoreceptor drum becomes approximately equal to one another, whereby it is assumed that the satisfactory transfer is possible for any one of the photoreceptor drums.

The other operation is to adjust the path of a charge between the transfer roller and the photoreceptor drum. A charge moves from the transfer roller to the photoreceptor drum via the intermediate transfer belt. The resistance value in the path therebetween is adjusted, that makes the transferring condition close to each other.

Adjusting the position of the transfer roller produces plural operations as described above, whereby a satisfactory transfer can be accomplished from all photoreceptor drums to the intermediate transfer belt or the like even if the same transfer roller is used for the respective photoreceptor drums each having a different diameter.

The embodiments of the present invention will be explained based upon the drawings.

FIG. 1 is a schematic constructional view of an image forming device according to one embodiment of the present invention.

This image forming device has four image forming units 1*a*, 1*b*, 1*c* and 1*d* for forming toner images of yellow, magenta, cyan and black, and an endless intermediate transfer belt 2 is supported so as to oppose to each of the image forming units 1. This intermediate transfer belt 2 is driven such that its peripheral surface is revolvingly moved. The toner images formed at the image forming units 1 are superimposed to be transferred onto the intermediate transfer belt 2. A secondary transfer roller 3 and a transfer opposing roller 4 are arranged, at the downstream side of the position where the intermediate transfer belt 2 opposes to the image forming units 1, so as to nip the intermediate transfer belt 2 to thereby press the same. A recording sheet is transported from a sheet tray 5 via a transport path 6 to this secondary transfer section. A fixing device 7 for heating and pressurizing the toner images to thereby fix the toner images onto the recording sheet is disposed at the downstream side of the secondary transfer section in the transport path of the recording sheet. Disposed at the further downstream side is a discharge tray 8 for accommodating the recording sheet having the toner images fixed thereon.

Each of the image forming units 1*a*, 1*b*, 1*c* and 1*d* has a photoreceptor drum 11 on which an electrostatic latent image is formed. Provided around the peripheral surface of each photoreceptor drum 11 area charging device 12 for approximately uniformly charging the surface of the photoreceptor drum, an optical scanning device 13 for scanning a laser beam onto the surface of the photoreceptor drum to thereby write the electrostatic latent image thereon and a developing device 14 for selectively transferring toner onto the latent image formed on the photoreceptor drum to thereby form toner image. Further, disposed at the inner side of the intermediate transfer belt 2 is a transfer roller 9 for primarily transferring the toner image onto the photoreceptor drum 11 to the intermediate transfer belt 2. This transfer roller 9 is pressed toward the photoreceptor drum via the intermediate transfer belt 2. A bias voltage for transfer is applied to this transfer roller 9 from a power supply device (not shown) to form an electric field between the transfer roller 9 and the photoreceptor drum 11.

These image forming units 1*a*, 1*b*, 1*c* and 1*d* form toner images of yellow, magenta, cyan and black in this order from the upstream side. As for the photoreceptor drums 11*a*, 11*b*, 11*c* and 11*d* used in these image forming units 1, each of the drums for forming yellow, magenta and cyan toner images has a diameter of 40 mm, while the drum for forming the black toner image has a diameter of 60 mm. These photoreceptor drums are brought into contact with the intermediate transfer belt 2 at the section where it is looped between a driving roller 21 and a support roller 22, wherein the photoreceptor drum 11*d* for black is arranged at the most downstream side. Moreover, as for the transfer roller 9, the same rollers are used for all image forming units 1*a*, 1*b*, 1*c* and 1*d*. Specifically, the transfer roller 9 has a coating layer mainly made of epichiorohydrin rubber formed on a core member made of a metal and has a diameter of 18.7 mm. The thickness of the coating layer is 5.35 mm and the hardness thereof is 35° (JIS K 6301, JIS A or JIS K 6253, durometer type A spring method). It is pressed toward the direction of the center of the photoreceptor drum with force of 0.098 N (10 g/cmf) per 1 cm in the widthwise direction of the periphery of the photoreceptor drum.

Figure 2:
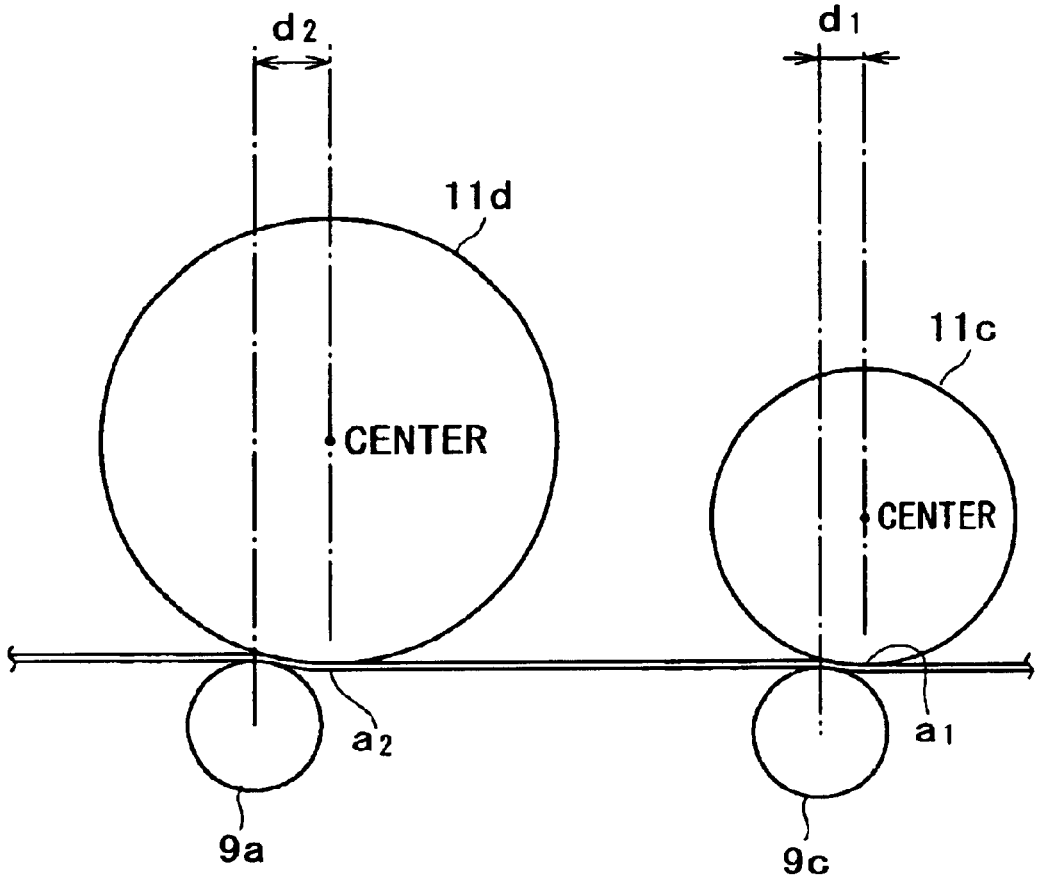
FIG. 2 is an enlarged view of a section where a photoreceptor drum and a transfer roller of the image forming device shown in FIG. 1 are in pressed contact with each other.

The transfer roller 9 is arranged so as to shift (offset) to the downstream side from the position (a point a shown in FIG. 2 that is hereinafter referred to as a contact reference position) on the peripheral surface of the photoreceptor drum where the direction for stretching the intermediate transfer belt 2 is made at right angles to the radius of the photoreceptor drum 11. The offset amount d is different depending upon the diameter of the photoreceptor drum. The transfer rollers 9 are arranged so as to be offset toward the downstream side by $d_1$=3 mm for the photoreceptor drums 11*a*, 11*b* and 11*c* having a diameter of 40 mm, while it is arranged so as to be offset toward the downstream side by $d_2$=5 mm for the photoreceptor drum 11*d* for black having a diameter of 60 mm.

On the other hand, the intermediate transfer belt 2 is a film made of polyimide resin having a thickness of about 10 to 300 $\mu$m, that are looped among the driving roller 21, support rollers 22 and 23 and the transfer opposing roller 4. The abovementioned four photoreceptor drums 11*a*, 11*b*, 11*c* and 11*d* oppose to the intermediate transfer belt 2 at the section where the intermediate transfer belt 2 is looped between the driving roller 21 and the support roller 22 disposed at the downstream side of the driving roller 21, and pressed toward the intermediate transfer belt 2 by the transfer rollers 9*a*, 9*b*, 9*c* and 9*d*. The driving roller 21 is rotatably driven to thereby revolvingly move the intermediate transfer belt 2 in the direction shown by an arrow in FIG. 1, whereby the transfer roller 9 rotates with the revolving movement of the intermediate transfer belt 2.

The abovementioned image forming device operates as follows.

Toner images of yellow, magenta, cyan and black are respectively formed at four image forming units 1*a*, 1*b*, 1*c* and 1*d* disposed so as to oppose to the intermediate transfer belt 2. The formation of the toner images is performed by the following process.

The respective photoreceptor drums 11 are approximately uniformly charged by the charging device 12, and then, a laser beam turned on/off according to an image signal is scanned on the peripheral surface of each photoreceptor drum 11 by the optical scanning device 13, thereby forming an electrostatic latent image. The scanned laser beam is turned on or off based upon image data that is color-resolved into yellow, magenta, cyan and black, whereby the electrostatic latent image corresponding to the toner image of each color is formed onto each photoreceptor drum. The electrostatic latent image on each photoreceptor drum 11 is developed by the respective developing devices 14 each containing yellow, magenta, cyan and black toner, thereby forming the toner images of each color on each photoreceptor drum 11.

The toner images of each color formed as described above are successively superimposed to one another to be transferred onto the intermediate transfer belt 2 by the transfer roller 9, thereby forming on the intermediate transfer belt 2 a color image in which toner images of four colors are superimposed. The toner images of four colors transferred onto the intermediate transfer belt 2 are transferred onto a recording sheet transported from the sheet tray 5 at the position where the intermediate transfer belt 2 opposes to the secondary transfer roller 3, and then, transported to the fixing device 7. At the fixing device 7, the recording sheet bearing the toner images is pressurized and heated to thereby melt the toner images for fixing onto the recording sheet, thereby obtaining a fixed image, and then, the recording sheet is discharged onto the discharge tray 8.

In the process for superimposing the toner images of each color to be transferred onto the intermediate transfer belt 2 from the photoreceptor drum 11, the position of the transfer roller 9 to the position of the photoreceptor drum 11 greatly changes the transferability. Accordingly, the transfer roller 9 is arranged to have a suitable distance d (offset amount) toward the downstream side from the contact reference position a, with the result that the transferring efficiency and satisfactory transferability are both obtained, thereby being capable of performing a suitable transfer. Specifically, when the transfer roller 9 is too close to the upstream side at the position proximate to the contact reference position a, a strong electric field occurs at the region before the photoreceptor drum 11 and the intermediate transfer belt 2 contact to each other, with the result that toner scattering in a space is produced to cause a defect in an image quality. This defect becomes remarkable at the low-density section in the image. On the other hand, when the transfer roller 9 is positioned too apart from the contact reference position a, transfer current between the photoreceptor drum 11 and the transfer roller 9 flows via a wide range of the intermediate transfer belt 2, which causes increased impedance, whereby the applied voltage is required to be set high for obtaining a desired transfer current. Therefore, cost requiring for the power supply is increased.

Further, in the case where the transfer roller 9 has an elastic layer of an ion-conductive type such as epichlorohydrin rubber, the resistance value fluctuates depending upon the environment, and further, it has a characteristic that the resistance value rises due to the repeated energization. Therefore, when the transfer roller 9 is positioned at the upstream side that is close to the contact reference position a, the resistance value of the transfer section is decreased too much under the high-temperature high-humidity condition, so that the voltage applied from the power source is excessively lowered to sometimes cause unstable output. Moreover, when the transfer roller 9 is positioned too apart from the contact reference position a, the resistance value rises due to the long-time use. Further, when the resistance value rises under the low-temperature low-humidity condition, high voltage is required to be applied.

Moreover, arranging the transfer roller 9 so as to shift toward the downstream side from the contact reference position a by a suitable distance, i.e., greatly shifting the transfer roller 9 toward the downstream side with respect to the large-diameter photoreceptor drum 11*a* allows a rapid separation of the intermediate transfer belt 2 from the photoreceptor drum 11. This can suppress a so-called release discharge generated at the section b where the intermediate belt 2 is separated from the photoreceptor drum 11, thereby reducing the retransfer of the transferred toner images onto the photoreceptor drum 11 or the image disturbance.

In the abovementioned image forming device, the transfer rollers 9*a*, 9*b* and 9*c* are arranged toward the downstream side from the contact reference position a by 3 mm ($d_1$) with respect to the photoreceptor drums 11*a*, 11*b* and 11*c* each having a diameter of 40 mm, while the transfer roller is arranged toward the downstream side from the contact reference position a by 5 mm ($d_2$) with respect to the photoreceptor drum having a diameter of 60 mm. These positions are approximately optimum positions, thereby enabling a suitable transfer.

Subsequently explained is an experiment for finding the optimum position of the transfer roller in the image forming device according to the above-mentioned embodiment.

An image was independently formed by use of each photoreceptor drum for forming toner images of each color and the formed images were transferred onto the intermediate transfer belt for evaluating the transferability thereof. The transfer roller having the resistance value of 6.4 Log Ω between itself and the photoreceptor drum was used. The position of the transfer roller was moved toward the downstream side from the contact reference position in 0.2-mm steps, whereby the transferability at each position was investigated. Note that the power source output was controlled such that the transferability was optimized within the range of from 0.1 kV to 5.6 kV in the voltage value and from 5 μA to 45 μA in the current value.

As a result, the position of the transfer roller where the suitable transfer was possible was such that the offset amount d toward the downstream side from the contact reference position was placed in the following values:

Transfer roller for yellow (Y) image: d=2.4 to 3.6 mm

Transfer roller for magenta (M) image: d=2.8 to 3.8 mm

Transfer roller for cyan (C) image: d=2.6 to 3.4 mm

Transfer roller for black (B) image: d=4.6 to 5.2 mm

In the above result, there is a slight difference among the arrangeable ranges of the transfer rollers for the toner images of yellow, magenta and cyan. This difference is assumed to occur from the difference in the charging state due to the difference in addition agent such as a color material or the like included in the toner.

Subsequently explained is a result of the investigation about the influence given by the position of the transfer roller arranged at the upstream side to the suitable arrangeable range of the transfer roller at the downstream side.

This experiment examined the position of the transfer roller where the satisfactory transfer was possible at the downstream side when the transfer roller at the upstream side was set to be shifted from the contact reference position by the offset amount of $d_1$=3 mm or $d_1$=3.5 mm.

As a result of the experiment, the range of the transfer roller that the satisfactory transfer is possible is as follows. Specifically, as the offset amount $d_1$ of the transfer roller at the upstream side is increased, the range of the transfer roller at the downstream side that the suitable transfer is possible is widened. Even when the offset amount $d_2$ is decreased, a satisfactory transfer is possible.

1. In the case cwWhere the offset amount $d_1$ of the transfer roller at the upstream side was 3 mm:

Transfer roller for magenta (M) image: d=2.0 to 3.8 mm

Transfer roller for cyan (C) image: d=2.4 to 3.4 mm

Transfer roller for black (K) image: d=4.6 to 5.2 mm

2. In the case where the offset amount $d_1$ of the transfer roller at the upstream side was 3.5 mm:

Transfer roller for magenta (M) image: d=1.6 to 3.8 mm

Transfer roller for cyan (C) image: d=2.0 to 3.4 mm

Transfer roller for black (K) image: d=4.4 to 5.2 mm

Figure 3:
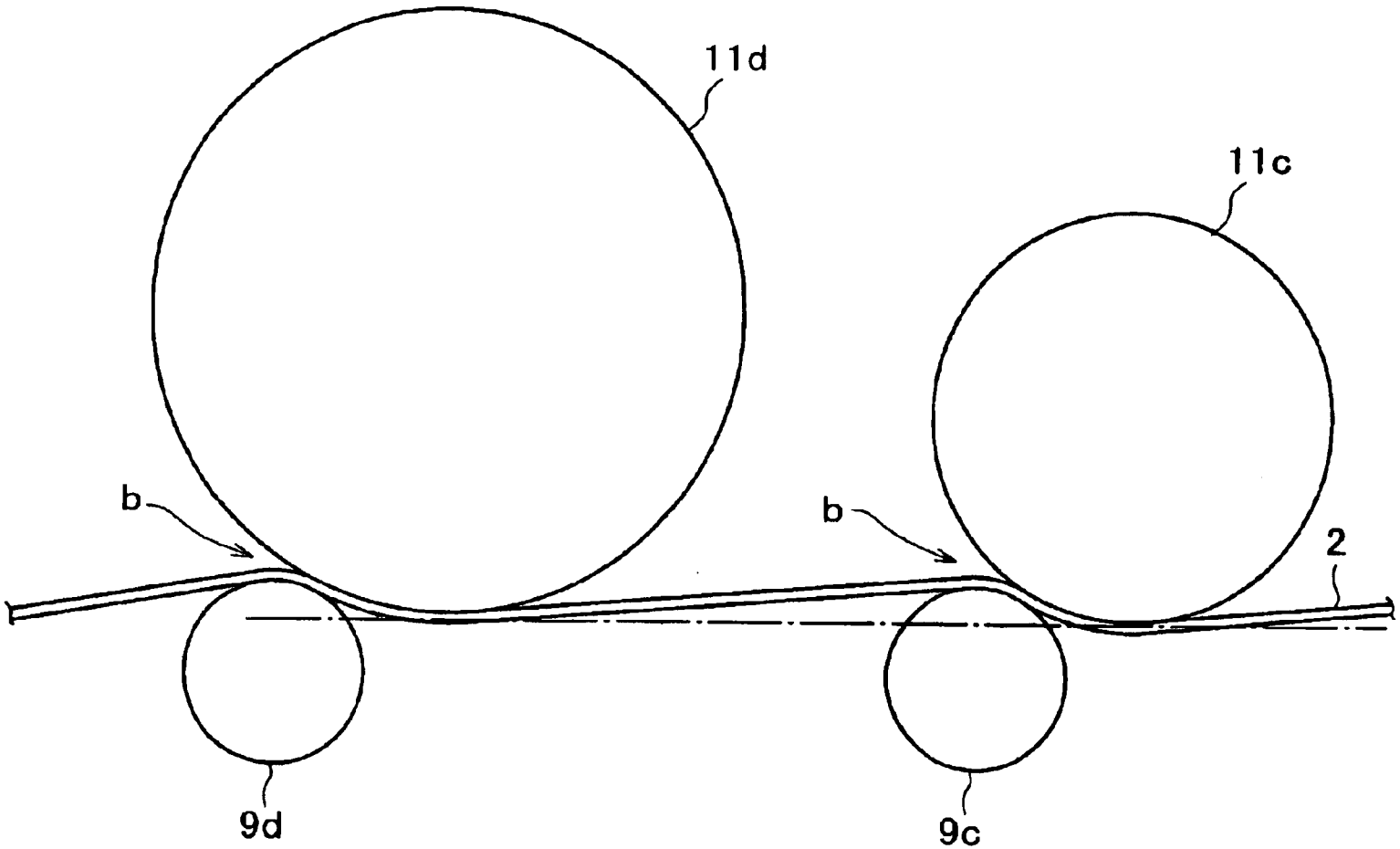
FIG. 3 is a schematic view showing a state of an intermediate transfer belt at the section where the photoreceptor drum and the transfer roller of the image forming device shown in FIG. 1 are in pressed contact with each other.
Figure 4:
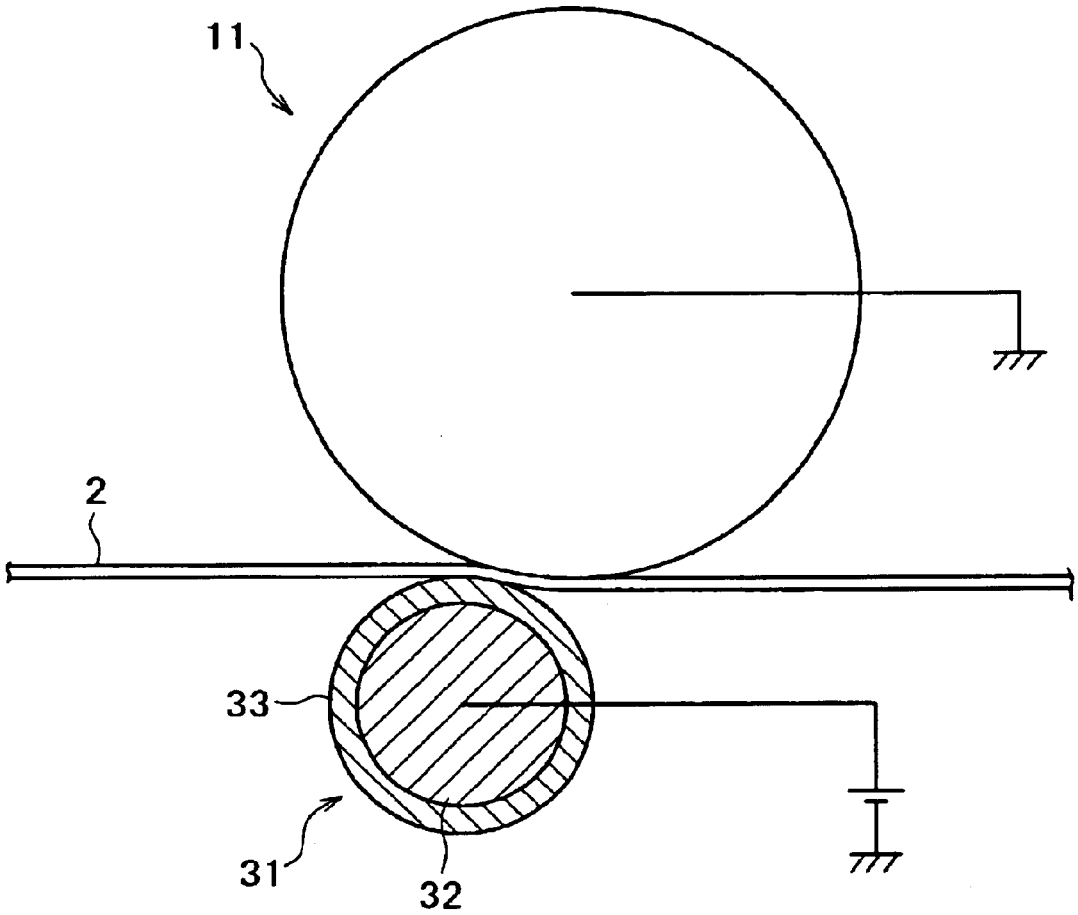
FIG. 4 is an enlarged view showing a section where a photoreceptor drum and a transfer roller of an image forming device according to another embodiment of the present invention are in pressed contact with each other.

Accordingly, setting great the offset amount $d_1$ of the transfer roller pressed toward the small-diameter photoreceptor drum arranged at the upstream side from the contact reference position a can decrease the difference between the offset amount $d_2$ for the large-diameter photoreceptor drum and the offset amount $d_1$ for the transfer roller at the upstream side, thereby facilitating the setting since the same pressing mechanism can be used. This operation is assumed to be attributed to the factor that the state of the release discharge is changed depending upon the position of the transfer roller at the upstream side and the factor that the contact angle between the intermediate transfer belt 2 and the photoreceptor drum at the downstream side is changed, as shown in FIG. 3.

Next, an image forming device that is one embodiment of the invention according to claim 5 will be explained.

This image forming device has the image forming units 1*a*, 1*b*, 1*c* and 1*d*, intermediate transfer belt 2, secondary transfer roller 3 and fixing device 7, all of which are the same as those of the image forming device shown in FIG. 1. Similarly, the diameter of the photoreceptor drum 11*d* for forming black toner image is greater than the diameter of each photoreceptor drum 11*a*, 11*b* and 11*c*. Transfer rollers 31 for transferring toner images onto the intermediate transfer belt from the photoreceptor drums have the same diameter, but the volume resistivity of an elastic layer 33 formed around a metallic core member 32 of the transfer roller for black pressed toward the large-diameter photoreceptor drum 11*d* differs from those of the other transfer rollers. The area of the contact surface differs from one another due to the difference in the diameter of the photoreceptor drum 11, but the transfer rollers 31 are adjusted to be in contact with the photoreceptor drums with approximately same pressure by adjusting the pressing force of the transfer roller 31. Further, the voltage applied to the respective transfer rollers 31 is controlled for every transfer roller 31 such that the amount of a current flowing per unit area of the contact surface becomes approximately equal to one another.

The transferability of the toner image is greatly influenced by the current amount per unit area. Adjusting the current amount as described above makes it possible to perform a satisfactory transfer from any one of the photoreceptor drums 11*a*, 11*b*, 11*c* and 11*d* each having a different diameter.

Figure 5:
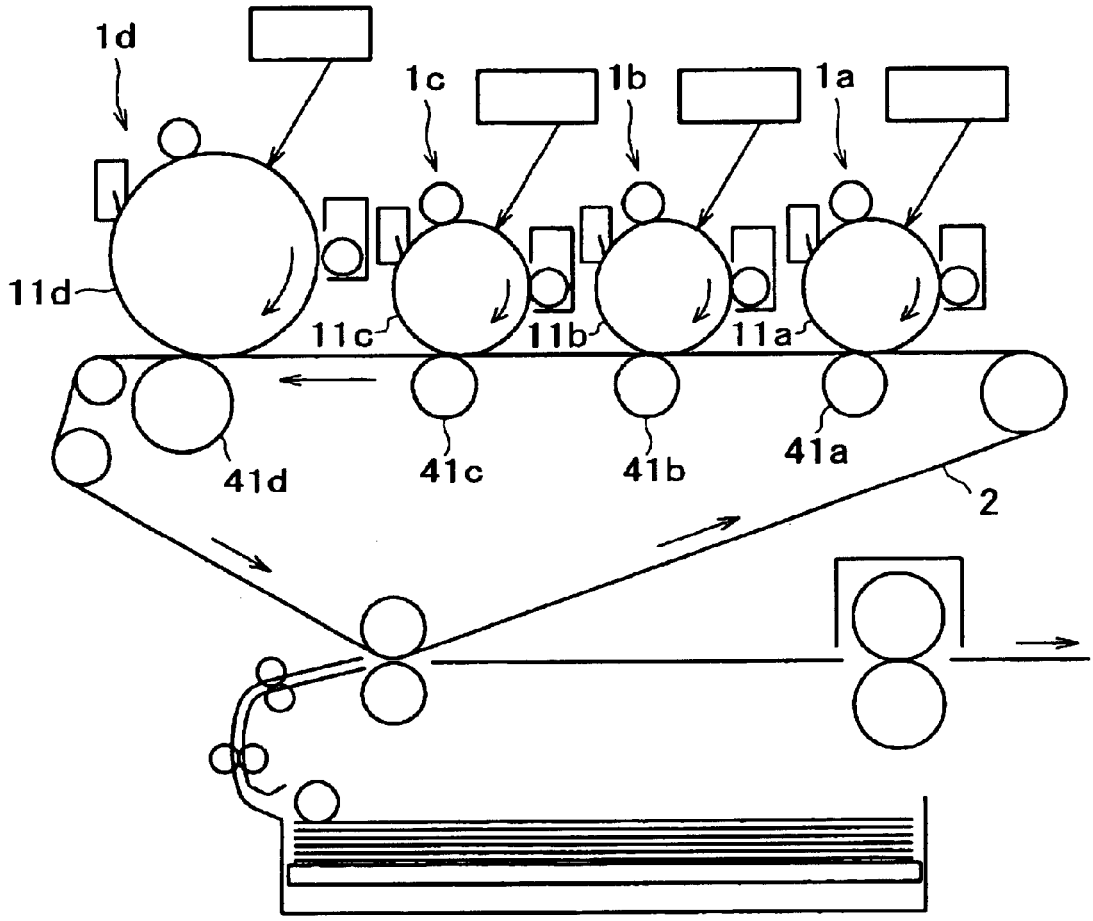
FIG. 5 is a schematic constructional view showing an image forming device according to another embodiment of the present invention.

FIG. 5 is a schematic constructional view showing an image forming device that is one embodiment according to the invention of claim 6.

In this image forming device, the diameter of each transfer roller 41*a*, 41*b*, 41*c* and 41*d* is changed according to the diameter of the photoreceptor drums 11*a*, 11*b*, 11*c* and 11*d*, compared to the image forming device shown in FIG. 1 wherein the transfer rollers 9*a*, 9*b*, 9*c* and 9*d* having the same specification are used for all image forming units 1*a*, 1*b*, 1*c* and 1*d*. Specifically, the transfer rollers having the diameter of 18.7 mm, same as those used in the image forming device shown in FIG. 1, are pressed toward the photoreceptor drums 11*a*, 11*b* and 11*c* for yellow, magenta and cyan having the diameter of 40 mm, while the transfer roller having the diameter of 28.1 mm is pressed toward the photoreceptor drum 11*d* for black having the diameter of 60 mm, wherein the ratio of the diameter of the photoreceptor drum 11 to the diameter of the transfer roller 41 pressed toward the photoreceptor drum is approximately equal. The other configurations of this image forming device are the same as those of the image forming device shown in FIG. 1.

In this image forming device, the photoreceptor drum 11 and the transfer roller 41 establish a geometrically similar relation, so that the transfer is performed under the close condition, thereby facilitating the setting for satisfactorily transferring the toner images of each color. Moreover, the diameter of the photoreceptor drum 11*d* and the diameter of the transfer roller 41*d* are both set to be great in the image forming unit 1*d* for black that is frequently used, whereby the useful periods of both are prolonged. This allows to make the useful periods of the photoreceptor drum 11*d* and the transfer roller 41*d* close to the useful periods of the photoreceptor drums 11*a*, 11*b* and 11*c* and the transfer rollers 41*a*, 41*b* and 41, thereby facilitating the maintenance management.

In the image forming device according to the present invention, a pressing force of the transfer roller to the large-diameter photoreceptor drum is preferably set so as to be greater than that of the transfer roller to the small-diameter photoreceptor drum in the abovementioned image forming device.

When the diameter of the photoreceptor drum is different, the pressed region of the pressed intermediate transfer belt or the like, i.e., the width in the advancing direction is made different due to the difference in its curvature. Specifically, when the same transfer roller is used, the curvature becomes small in the large-diameter photoreceptor drum, so that the pressed width becomes large, while the pressed width becomes small in the small-diameter photoreceptor drum. If the force for pressing the transfer roller is constant, pressure per unit area becomes small in the large-diameter photoreceptor drum, while the pressed area becomes small but the pressure is increased in the small-diameter photoreceptor drum. When the pressure becomes excessive, a transfer defect that is called an image-missing occurs in the line image. Further, when the pressure is too small, the device is susceptible to the vibration or the like of the device, so that the disturbance appears on the transferred toner image.

On the other hand, the contact pressure by the pressing force of the transfer roller is suitably adjusted to the respective photoreceptor drums each having a different diameter, thereby enabling a satisfactory transfer from any one of the photoreceptor drums.

In the abovementioned image forming device, the photoreceptor drum having the largest diameter is preferably arranged at the most downstream side in an advancing direction of the endless belt, and the transfer roller is preferably pressed toward the small-diameter photoreceptor drum that is disposed at an upstream side of the photoreceptor drum having the largest diameter, at the downstream section within a range where the satisfactory transfer is possible.

The transfer roller of the upstream side is disposed at the downstream side as much as possible within the range where the suitable transfer is possible, which allows to widen the range where the transfer roller pressed toward the photoreceptor drum disposed at the downstream side thereof can be arranged. Specifically, a suitable transfer is made possible within a wide range. Even when the transfer roller is arranged close to the contact reference position with respect to the large-diameter photoreceptor drum, a suitable transfer is possible. This allows to increase the freedom in the arrangement, thereby facilitating the positional adjustment or the like.

Further, a power supply device for applying a transfer voltage between the transfer roller and the photoreceptor drum controls an output voltage for every one of the transfer rollers, whereby it can correct that the transferring conditions differ from one another depending upon the difference in the diameter of the photoreceptor drums.

Although this invention uses the transfer roller of the same specification for the plural photoreceptor drums each having a different diameter, the transfer roller may have a conductive rubber layer along the peripheral surface thereof, the volume resistivity of the rubber layer being varied depending upon the diameter of the photoreceptor drum. With this configuration, the pressing force of the transfer roller can be set so as to be changed for every transfer roller. In this case, the voltage applied between the transfer roller and the photoreceptor drum is controlled such that the values of the current flowing per unit area of both pressed surfaces become approximately equal to each other. The approximately equal transferring efficiency can be obtained for the photoreceptor drums each having a different diameter by setting the current values per unit area equal to each other as described above.

Moreover, the transfer roller of the different diameter can be used according to the diameter of the pressed photoreceptor drum. Specifically, the ratio of the diameter of the transfer roller to the diameter of the photoreceptor drum is set approximately equal for the photoreceptor drums each having a different diameter, resulting in unifying the geometrical relation, and hence, the transfer is performed with a condition that is approximately close to the condition for each photoreceptor drum. Further, when the transfer roller has the conductive rubber layer along the peripheral surface thereof, the useful period can be made approximately equal among the plural transfer rollers. Specifically, the conductive rubber layer has the resistance value gradually increasing upon the repeated energization, thereby changing the transferring condition to cause a transfer defect. However, increasing the diameter of the transfer roller decreases the period when each section on the peripheral surface is in pressed contact with the photoreceptor drum to be energized. This prolongs the useful periods of the large-diameter photoreceptor drum that is frequently used and the transfer roller that is pressed toward this photoreceptor drum. Consequently, the useful period of these becomes approximately equal to the useful periods of the other photoreceptor drums and transfer rollers.

As described above, in the image forming device of the present invention, the diameter of the photoreceptor drum for forming a black toner image is increased, so that the useful period of this photoreceptor drum is not greatly different from those of the other photoreceptor drums even if this photoreceptor drum and the transfer roller are frequently used. The toner images can suitably be transferred from any one of the photoreceptor drums each having a different diameter, whereby these toner images are superimposed to form a satisfactory color image.

The entire disclosure of Japanese Patent Application No. 2003-325786 filed on Sep. 18, 2003 including specification, claims, drawings and abstract is incorporated herein by reference in its entirety.

What is claimed is:

1. An image forming device comprising:

a plurality of photoreceptor drums on which a latent image is formed on a cylindrical peripheral surface by a difference in electrostatic potential and on which toner images of different color are respectively formed due to deposition of toner;

an endless belt looped between two support rollers to be in contact with any one of the plurality of photoreceptor drums wherein the toner images on the photoreceptor drums are superimposed to be transferred onto an outer peripheral surface or a recording sheet carried on the outer peripheral surface; and transfer rollers that are in pressed contact with the respective photoreceptor drums from an inner side of the endless belt; wherein the plurality of photoreceptor drums include one having a different diameter from one another, the transfer rollers are made of an identical material and have an identical diameter, each of the transfer rollers is in pressed contact with each of the photoreceptor drums at a downstream side with respect to a moving direction of the endless belt from a position (hereinafter referred to as a contact reference position) of the peripheral surface of the photoreceptor drum where a radius of the photoreceptor drum is approximately perpendicular to a direction that the endless belt is looped, and a distance from the contact reference position to a pressed position of the transfer roller of a large-diameter photoreceptor drum is set greater than that of a small-diameter photoreceptor drum.

2. The image forming device according to claim 1, wherein the pressing force of the transfer roller to the large-diameter photoreceptor drum is set to be greater than that of the transfer roller to the small-diameter photoreceptor drum.

3. The image forming device according to claim 1, wherein the photoreceptor drum having the largest diameter is arranged at the most downstream side in an advancing direction of the endless belt, and the transfer roller is pressed toward the small-diameter photoreceptor drum that is disposed at an upstream side of the photoreceptor drum having the largest diameter, at the downstream section within a range that the satisfactory transfer is possible.

4. The image forming device according to claim 1, wherein a power supply device for applying a transfer voltage between the transfer roller and the photoreceptor drum controls an output voltage for every one of the transfer rollers.

5. The image forming device comprising:

a plurality of photoreceptor drums on which a latent image is formed on a cylindrical peripheral surface by a difference in electrostatic potential and on which toner images of different color are respectively formed due to deposition of toner;

an endless belt looped between two support rollers to be in contact with any one of the plurality of photoreceptor drums wherein the toner images on the photoreceptor drums are superimposed to be transferred onto an outer peripheral surface or a recording sheet carried on the outer peripheral surface; and transfer rollers that are in pressed contact with the respective photoreceptor drums from an inner side of the endless belt; wherein the plurality of photoreceptor drums include one having a different diameter from one another, each of the transfer rollers has a conductive rubber layer along its peripheral surface, and volume resistivity of the rubber layer of each of the transfer rollers and a pressing force of each of the transfer rollers are set for everyone of the photoreceptor drums having a different diameter such that a current flowing per unit area of a pressed surface pressed toward the photoreceptor drum via the endless belt becomes approximately equal in each of the transfer rollers and a voltage applied between the transfer roller and the photoreceptor drum is controlled for every one of the transfer rollers.

6. An image forming device comprising:

a plurality of photoreceptor drums on which a latent image is formed on a cylindrical peripheral surface by a difference in electrostatic potential and on which a toner image of different color is respectively formed due to deposition of toner;

an endless belt looped between two support rollers so as to be in contact with any one of the plurality of photoreceptor drums wherein the toner images on the photoreceptor drums are superimposed to be transferred onto an outer peripheral surface or a recording sheet carried on the outer peripheral surface; and transfer rollers that are in pressed contact with the respective photoreceptor drums from an inner side of the endless belt; wherein the plurality of photoreceptor drums include one having a different diameter from one another, and a ratio of the diameter of the transfer roller to the diameter of the photoreceptor drum is placed at the same position even to a photoreceptor drum having a different diameter.

7. An image forming device comprising:

a plurality of photoreceptor drums on which a latent image is formed, wherein one of the photoreceptor drum is different diameter from the other photoreceptors;

a belt in contact with the plurality of photoreceptor drums; and a plurality of transfer rollers pressing the photoreceptor drums from a side of the belt, the side being opposite to the side contacting with the photoreceptor;

wherein a distance from a contact reference position, the contact reference position at which the photoreceptor being contact with the belt, to a pressed position of the transfer roller of a large-diameter photoreceptor drum is greater than that of a small-diameter photoreceptor drum.

* * * * *